US005588447A

United States Patent [19]

Gueret

[11] Patent Number: 5,588,447

[45] Date of Patent: Dec. 31, 1996

[54] BRUSH FOR APPLYING NAIL VARNISH AND METHOD

[75] Inventor: Jean-Louis H. Gueret, Paris, France

[73] Assignee: L'Oreal, Paris, France

[21] Appl. No.: 337,223

[22] Filed: Nov. 7, 1994

[30] Foreign Application Priority Data

Nov. 5, 1993 [FR] France ..... 93 13214

[51] Int. Cl.[6] ..... A45D 34/04; A46B 3/16

[52] U.S. Cl. ..... 132/200; 15/167.3; 15/191.1; 15/195; 15/207.2; 15/DIG. 5; 15/DIG. 6; 401/129; 427/429

[58] Field of Search ..... 15/159.1, 160, 15/167.3, 190, 191.1, 195–199, 205, 207.2, DIG. 5, DIG. 6; 132/73, 74.5, 320, 200; 401/129; 427/429

[56] References Cited

U.S. PATENT DOCUMENTS

| | | | |
|---|---|---|---|
| 999,820 | 8/1911 | Martin | 15/205 |
| 2,508,799 | 5/1950 | Reis, Jr. | 15/207.2 |
| 2,668,311 | 2/1954 | Parry | 15/199 |
| 3,186,765 | 6/1965 | Gentoso | 15/160 |
| 3,343,195 | 9/1967 | Menges | 15/207.2 |
| 4,305,234 | 12/1981 | Pichelman . | |
| 4,927,281 | 5/1990 | Gueret | 15/207.2 |
| 5,022,112 | 6/1991 | Burns | 15/207.2 |
| 5,167,760 | 11/1992 | Gueret | 300/21 |

FOREIGN PATENT DOCUMENTS

| | | | |
|---|---|---|---|
| 0239270 | 9/1987 | European Pat. Off. . | |
| 0329505 | 8/1989 | European Pat. Off. . | |
| 0519677 | 12/1992 | European Pat. Off. . | |
| 958310 | 3/1950 | France | 15/196 |
| 1134245 | 11/1956 | France | 15/DIG. 6 |
| 2248806 | 5/1975 | France | 15/195 |
| 2637472 | 4/1990 | France . | |
| 2687055 | 8/1993 | France . | |
| 3841986 | 4/1990 | Germany . | |
| 359712 | 6/1938 | Italy | 15/195 |
| 4090709 | 3/1992 | Japan . | |
| 149390 | 1/1962 | U.S.S.R. | 15/207.2 |
| 2017490 | 10/1979 | United Kingdom . | |
| 2247400 | 3/1992 | United Kingdom . | |

*Primary Examiner*—Mark Spisich
*Attorney, Agent, or Firm*—Staas & Halsey

[57] ABSTRACT

A brush for the application of nail varnish, or a similar product, includes a tuft obtained from a bundle of bristles which are substantially parallel and folded in two halfway along their length. The bristles are fixed at the folded part in a housing opening at the end of the rod. The bristles have cross-sections bounded by a circle of constant diameter and are chosen from at least two groups. The bristles of one group are arranged so as to exhibit a different mechanical behavior in flexure to that of the bristles of the other group so that these groups give a brush tuft which is open to the air and spread out, with relatively large spaces between bristles to promote good capillary action for varnishes whose viscosity may vary over a wide range.

30 Claims, 1 Drawing Sheet

BRUSH FOR APPLYING NAIL VARNISH AND METHOD

BACKGROUND OF THE INVENTION (1) Field of the Invention

The invention relates to a brush for applying nail varnish, or a similar product, of the kind which includes bristles forming a tuft, these being fixed at an end of a rod and oriented substantially along the axial direction of the rod.

(2) Description of Related Art

FR-A-2,687,055 discloses a brush of this type which makes it possible, with conventional nail-varnish compositions, to effect precise and rapid application of the varnish. In particular, with such a brush, it is no longer necessary to dip the brush a number of times into the container in order to effect the make-up of a nail since the amount of product taken up by the brush is relatively high.

Conventional nail-varnish compositions, commonly used, have viscosities of approximately 200 centipoise to 400 centipoise (200 to 400 cP). However, nail-varnish compositions under development have higher viscosities, especially approximately 600 cP (centipoise). Compositions are also envisioned which are even more viscous.

During trials, it became apparent that known nail-varnish brushes, especially a brush such as the one mentioned hereinabove, are not entirely satisfactory for applying varnish compositions whose viscosity is greater than the range of conventional viscosities. In particular brushes known hitherto are not entirely satisfactory for applying varnishes whose viscosity is of the order of, or greater than 600 cP.

SUMMARY OF THE INVENTION

The object of the invention is, above all, to provide a nail-varnish brush which makes it possible, even with varnishes having a high viscosity, in particular viscosities greater than 600 cP, to apply the product under good conditions, while still being able to be used for the application of conventional nail varnishes.

The object of the invention is also to provide a brush which, while still meeting the requirement mentioned hereinabove, remains simple and economical to manufacture and conventional to use.

In order to solve this problem, according to a first solution, a brush according to the invention, for applying nail varnish or a similar product, includes bristles forming a tuft obtained from a bundle of bristles which are substantially parallel and folded in two approximately halfway along their length. The bristles are fixed at the end of a rod by engagement, with clamping, of the folded part of the bristle tuft in a housing opening at the end of the rod. The bristles have cross-sections admitting a circumscribed circle of constant diameter. The bristles of the tuft are chosen from two groups, the bristles of one group being arranged so as to exhibit mechanical behavior in flexure different from that of the bristles of the other group so that, when bending and clamping the various groups of bristles, these groups give a brush tuft which is open to the air and spread out with relatively large spaces between bristles, these being favourable for good capillary action for varnishes whose viscosity may vary over a wide range.

According to a first possibility, the bristles of one group are made of a different material from the bristles of another group, these different materials having different elasticity coefficients leading to different mechanical behavior of the groups of bristles, the elasticity coefficient of the material of a bristle of a first group varying by from 10% to 200% with respect to the elasticity coefficient of the material of a bristle of another group.

According to another possibility, which may be combined with the previous one, the bristles of one group have a cross-sectional shape different from that of the bristles of another group, these shape differences leading to differences in flexural resistance, even if the material of the bristles of the various groups is identical.

A first group of bristles may comprise 5 to 95% of the total number of bristles in the brush, the second group, or all the other groups, being constituted by the complement, namely 95 to 5% with respect to the total number of bristles.

The brush may include a third group of different bristles, the number of which may vary from 90% to 10% with respect to the total number of bristles in the brush.

The most flexible bristles may be made of a polyamide, for example the polyamide known by the commercial name Tynex of the Dupont de Nemours company, or made of a polyether-block-amide or a polyester elastomer. The material used for the less flexible bristles may be chosen from the group: Rilsan, polyamide, polyethylene, polytetrafluoroethylene, polyvinylidene fluoride, polyacetate, and polyethylene terephthalate.

In order to solve the same problem, according to a second solution, a housing of a special shape may also be used: the invention therefore also relates to a brush for the application of nail varnish, or of a similar product, including bristles forming a tuft which are fixed at the end of a rod by engagement of the bristle tuft in the housing opening at the end of the rod. The bristles have cross-sections admitting a circumscribed circle of constant diameter. The housing has a flared shape, the large base of which is located at the end of the rod, this shape giving a brush tuft which is open to the air and spread out with relatively large spaces between the bristles, these being favorable for good capillary action for varnishes whose viscosity may vary over a wide range.

The tuft of the brush may be obtained from a bundle of bristles which are substantially parallel and folded in two approximately halfway along their length, the folded part of the bristle tuft being engaged, with clamping, in the housing of the rod.

Furthermore, the cross-section of the end of the rod may have any shape. It may, by way of example, be round, square, rectangular, triangular, oval or cruciform.

In particular, the housing may have the shape of a truncated cone, a pyramid or a funnel; it may also be cylindrical with a shoulder defining a region of larger diameter than the bottom region of the housing where the embedding of the tuft takes place.

According to the second solution, the bristles may be identical or different. They are especially made of synthetic or natural material. The natural material may be normally chosen from natural silks, preferably of animal origin. The synthetic material may be chosen from the group formed by polyamides, polyesters, polyether-block-amides, polyethylenes, polytetrafluoroethylenes, polyvinylidene fluorides, polyacetals, and polyethyleneterephthalates.

The brush of the invention is capable of applying, in particular, varnishes whose viscosity lies within the 200 to 2,000 cP range, limits inclusive. In practice, the brush of the invention permits correct application of liquid product whose viscosity may vary within a range going from approximately 1.2 to approximately 3,500 cP.

In a manner known per se, the folded region of the bristles may be held in place, in the rod, by a staple forcibly pushed into the housing of the rod.

The length by which the bristles of the brush project beyond the end of the rod may be between 12 and 30 mm, limits inclusive.

The diameter of the circle circumscribing the cross-section of a bristle is between 3/100 mm and 18/100 mm, limits inclusive; this diameter is the same for all the bristles of one and the same brush.

The shape of the cross-section of a bristle is chosen particularly from the following shapes: solid circular, hollow circular, horseshoe-shaped, V-shaped, flat, cruciform, or one equipped with capillary grooves.

Additives modifying the surface finish and the surface tension may be incorporated into the material of the bristles of the brush.

The invention includes, apart from the arrangements mentioned hereinabove, of a certain number of other arrangements which will be explained in more detail hereinbelow with regard to illustrative embodiments described with reference to the herein appended drawing, these being, however, in no way limiting.

BRIEF DESCRIPTION OF THE DRAWING

Finally.

DESCRIPTION OF THE PREFERRED EMBODIMENTS

Figure 1:
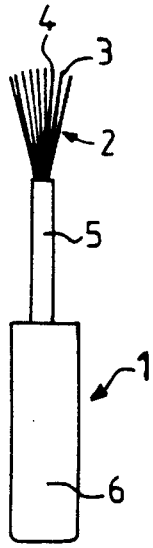
FIG. 1 is an elevation view of a nail-varnish brush according to the invention.

Referring to FIG. 1 of the drawings, a brush 1 for the application of nail varnish may be seen, including a tuft 2 of bristles 3, 4, these being fixed at an end of a rod 5 and oriented substantially along the axial direction of the rod. A cylindrical sleeve 6 is integral with that end of the rod 5 opposite the tuft 2 and engaged in the sleeve. This cylindrical sleeve 6 serves as a member for handling the brush; it also serves as a stopper intended, for example, to be screwed onto the neck of a bottle of varnish.

Figure 2:
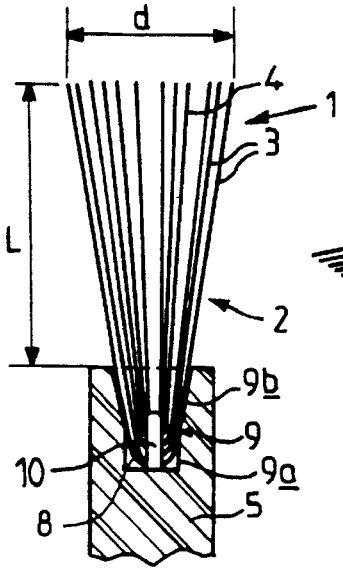
FIG. 2 is a diagrammatic view on a larger scale, in partial axial cross-section, of an end of the rod equipped with the bristle tuft.
Figure 3:
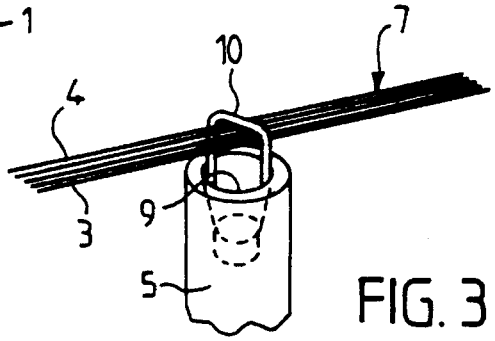
FIG. 3 is a view of a bundle of substantially parallel bristles serving for the manufacture of the brush.
Figure 4:
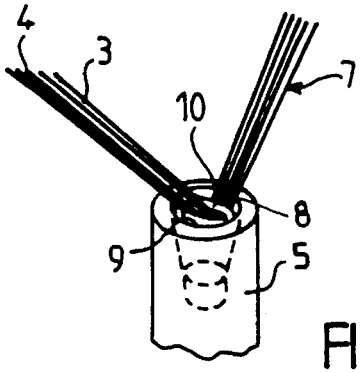
FIG. 4 is a diagrammatic view illustrating the engagement of the tuft of folded bristles, in a housing of the rod.

The tuft 2 is obtained from a bundle 7 (FIG. 3) of bristles 3, 4 which are substantially parallel and folded in two approximately halfway along their length, as illustrated in FIG. 4. The tuft 2 is fixed at the end of the rod 5 by engagement, with clamping, of the folded part 8 (see FIG. 2) of the bristle tuft in a housing 9 formed by a blind hole opening at the end of the rod 5.

All the bristles 3, 4 have a cross-section admitting a circumscribed circle C (see FIGS. 6 to 11) of constant diameter.

The bristles 3, 4 are chosen from at least two groups: the bristles 3 of one group are arranged so as to exhibit mechanical behavior in flexure different from that of the bristles 4 of the other group so that, when folding and clamping the various groups of bristles, these groups give a tuft 2 which is open to the air and spread out.

Figure 5:
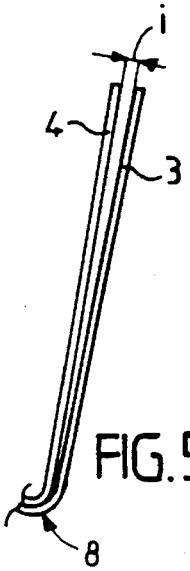
FIG. 5 is a diagrammatic view, on a larger scale, of brush bristles belonging to two different groups.

In particular, a bristle 3 (see FIG. 5), for example more rigid than a bristle 4, will form, when bending, a more open "V" than that formed by a bristle 4. A relatively large gap 3 is thus created between the end of the bristle 3 and the adjacent end of a bristle 4. 0f course, this gap decreases from the free end of the bristles down to the fold region 8. The existence of the gap between the bristles 3 and 4 promotes good capillary action for varnishes of high viscosity.

The opening-to-the-air and the spreading-out of the bristle tuft 2 result from the combined effect of the bending of the bundle 7 substantially halfway along the length and of the engagement, with clamping, of the folded part 8 in the housing 9. The interaction of a region of the tuft 2 with the walls of the housing 9 and the clamping of this tuft in the housing come into play in the formation of the plume of the tuft 2.

Generally, the tuft 2 is made, as illustrated in FIGS. 3 and 4, by placing the middle region of the bundle 7 on the entrance of the housing 9 of the rod 5. A staple 10 is engaged around the region located substantially halfway along the length of the bundle 7 and is pushed into the housing 9, resulting in the folding of the bristles 3, 4 which end up bearing against the edge of the housing 9. During this operation, the staple 10 is bent so as to clamp the bristles and is forceably engaged in the rod 5.

Figure 15:
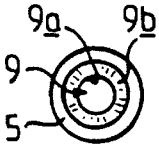
FIGS. 15 to 17 illustrate possible cross-sections for the housing of the end of the brush receiving the bristle tuft.

The staple 10 is made from a metal wire, bent into a U, the cross-section of which may be circular, flat rectangular or square. The diameter or the long side of the cross-section of the wire is advantageously between 0.2 mm and 1.5 mm The bottom region 9*a* (FIGS. 2 and 15) of the housing 9, where the embedding of the staple takes place, may be axisymmetrically cylindrical, whereas the upper part 9*b* of the housing, located beyond this cylindrical region, has a flared axisymmetrically frustoconical, shape, the large base of which is located at the open end of the housing 9. The tuft 2 of the brush embedded in such a housing has a shape in the form of a truncated cone with a substantially circular base.

Figure 16:
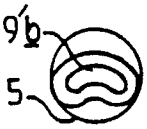

Other shapes are possible for the housing. For example, as illustrated in FIG. 16, the upper part 9'*b* (flared or non-flared) may have a cross-section in the shape of a kidney bean or a banana. According to another possibility, the cross-section of the upper part has an oval shape, a flattened rectangular shape or a shape in the form of a cross.

Figure 17:
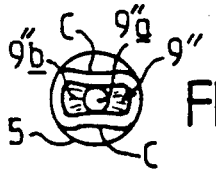

FIG. 17 illustrates an advantageous variant of the shape of the housing 9". An axisymmetrically cylindrical part 9"*a*, in the bottom of the housing, may be seen again. The flared upper part 9"*b* has a substantially flattened rectangular shape, the long sides of which are curved inwards in order to exhibit an outward-facing concavity. The end of the rod 5 therefore includes two concave faces c forming, as it were, a supply channel for the flow of the product from the rod towards the tuft of the brush.

Depending on the various cross-sectional shapes of the housing 9, 9', 9", and especially of the flared part, the contour of the tuft 2 is consequently altered and substantially reproduces, on a larger scale, the shape of the cross-section of the housing.

In order to achieve different mechanical behavior in flexure for the two groups of bristles 3 and 4, according to a first possibility, different materials having different elasticities are chosen for each group of bristles 3, 4. The elasticity of material is characterized by the elastic modulus or Young's modulus. The elasticity of the material of a bristle 3 of the first group varies, preferably, by from 10% to 200% with respect to the elasticity of a bristle of the second group.

Under these conditions, the bristles 3 and 4 made of different materials, even if they have cross-sections of identical shapes, these being inscribed in a circle of the same diameter, will exhibit a different mechanical behavior in flexure.

The most flexible bristles may be made of a polyamide, for example the polyamide known by the commercial name Tynex of the Dupont de Nemours company, or a polyether-block-amide, or a polyester elastomer. The least flexible bristles may be made of a material chosen from the group: Rilsan, polyamide, polyethylene, polytetrafluoroethylene, polyvinylidene fluoride, polyacotate, and polyethylene terephthalate.

Examples are given hereinbelow of brushes made with bristles of different materials with the same circumscribing circle diameter.

A first brush was made with bristles of 8/100 mm diameter with 50% of Rilsan bristles and 50% of PA-6,10 (nylon-6, 10) bristles.

Another example is a brush made with 30% of Rilsan bristles of 8/100 mm diameter and 70% of PA-6,6, also of 8/100 mm diameter.

Another example corresponds to 30% of PET (polyethylene terephthalate) bristles of a 10/100 mm diameter and 70% of PA-6,12 bristles, also of 10/100 mm.

According to another possibility, which may be combined with the previous one, a different mechanical behavior in flexure for a group of bristles 3 compared to a group of bristles 4 is obtained by giving the cross-section of the bristles different shapes, leading to differences in flexural resistance.

Figure 6:
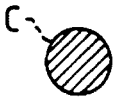
FIGS. 6 to 11 are diagrams of various possible cross-sections of the bristles, inscribed in a circle of constant diameter.
Figure 7:
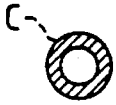

For example, the least flexible bristles 3 will have a solid circular cross-section, as illustrated in FIG. 6, whereas the more flexible bristles 4 will have a hollow circular cross-section such as that of FIG. 7, the external diameter of the bristles being the same.

Figure 9:
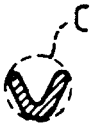
Figure 11:
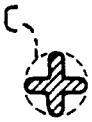
Figure 8:
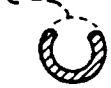
Figure 10:
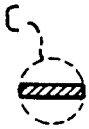

Other cross-sectional shapes may be combined, for example a horseshoe-shaped cross-section such as that of FIG. 8, a V-shaped cross-section such as that of FIG. 9, or a rectangular flat cross-section such as that of FIG. 10, or a cruciform cross-section such as that of FIG. 11.

The diameter of the circumscribing circle C of a bristle is between 3/100 mm and 18/100 mm.

The first group of bristles 3 constitutes 5 to 95% with respect to the total number of bristles in the brush, whereas the second group of bristles 4, or all the other groups, is constituted by the complement, that is to say 95 to 5% with respect to the total number of bristles.

An example of a brush, with two groups of bristles made of different materials and having different cross-sectional shapes, was made with 50% of Rilsan FAC bristles (horseshoe-shaped cross-section) and 50% of PA-6,12 bristles with a solid circular cross-section, the diameter of the circle circumscribing the cross-sections of the bristles being 8/100 mm.

The cross-section of the bristles may include at least one capillary groove, not depicted in the drawing.

The length L (FIG. 2) by which the bristles project beyond the end of the rod 5, or the visible length of the bristles, is advantageously between 12 and 30 mm. In the case of a circular cross-section housing 9, the diameter of the cross-section of the housing may be approximately 2 mm. With a length L of approximately 13 mm and bristles of a 8/100 mm diameter, the diameter d (FIG. 2) of the large base of the plume of tufts of the brush is greater than 4 mm, while under similar conditions a conventional brush would have a smaller end diameter d, for example of the order of 2.5 to 3 mm.

Figure 12:
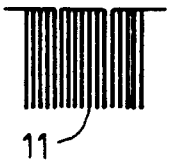
FIGS. 12 and 13 show, in elevation, on a large scale, two possible shapes for an end part of the brush.
Figure 13:
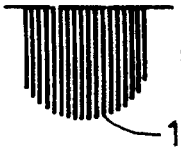
Figure 14:
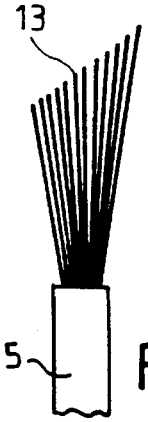
FIG. 14 is a side view of one possible end shape for the end part of the brush.

The end of the brush may be straight, orthogonal to the axis of the rod, as illustrated at 11 in FIG. 12, or may have a convex curved shape 12, as illustrated in FIG. 13. According to another possibility, the end of the brush may be cut in a plane 13 inclined with respect to the axis of the rod, as illustrated in FIG. 14.

In order to solve the problem of the invention, according to a second solution, only the special shape of the housing 9 may be used. In this case, the bristles forming a tuft are fixed at the end of the rod 5 by engagement of the bristle tuft in the housing 9. The bristles 3, 4 may not be folded in two approximately halfway along their length. The housing 9 has a flared shape *9b*, the large base of which is located at the end of the rod 5. This shape *9b* gives a brush tuft which is open to the air and spread out with relatively large spaces between the bristles, these being favorable to good capillary action for varnish whose viscosity may vary over a wide range.

Furthermore, the cross-section of the end of the rod 5 may have any shape. It may, by way of example, be round, square, rectangular, triangular, oval or cruciform.

In particular, the housing 9 may be in the form of a truncated cone or pyramid or a funnel; it may also be cylindrical with a shoulder defining a region of larger diameter than the bottom region *9a* of the housing where the embedding of the tuft takes place.

According to the second solution, the bristles 3, 4 may be identical or different. They are made especially of a synthetic or natural material. The natural material may normally be chosen from natural silks, in particular of animal origin. The synthetic material may be chosen from the group formed by polyamides, polyesters, polyether-block-amides, polyethylenes, polytetrafluoroethylenes, polyvinylidene fluorides, polyacetals, and polyethylene terephthalates.

Preferably, bristles are used whose diameter is chosen from 11 hundredths to 40 hundredths of a millimeter and preferably from 14 hundredths to 17 hundredths of a millimeter. The bristles are preferably hollowed.

It is possible to incorporate, into the material of the bristles, additives modifying the surface finish and the surface tension.

The mixed bristles of the brush may be straight or corrugated. The bristles may be ground off or tapered. The brush may have bristles at various levels.

A brush in accordance with the invention has:

- a difference in surface tension between the bristles of the various groups;
- a greater separation of the bristles and therefore an enhanced capillary action and a greater retention, this leading to greater autonomy.

Such a brush may apply liquids with the consistency of alcohol up to those with creamy consistencies. In other words, such a brush may apply liquid products whose viscosity varies within a range of approximately 1.2 to 3,500 cP.

The brushes of the invention are going to enable varnish compositions to be developed which have viscosities greater than the conventional viscosities generally lying between 200 to 400 cP. It will, in particular, be possible to develop water-based varnishes having a viscosity of approximately 600 cP.

In addition, the capacities of the new brush enable the varnish to be applied without having to shake the bottle containing this varnish beforehand.

Currently, when a nail varnish is applied, it is desirable to shake the bottle before use so as to alter the thixotropy. In fact, a conventional nail varnish in the rest state is generally too viscous (for example a viscosity of 2000 cP) for satisfactory application with conventional brushes; after shaking, the viscosity of the conventional nail varnish lies within a range of approximately 300 to 400 cP, this being acceptable for conventional brushes.

A brush according to the invention may accept the viscosity (approximately 2000 cP) of a conventional varnish in the rest state, so that it is not necessary to shake the bottle of varnish before use.

I claim:

1. Brush for the application of varnishes, comprising bristles forming a tuft obtained from a bundle of bristles which are substantially parallel and folded in two approximately halfway along their length, the folded part being fixed in a housing opening at an end of a rod, the bristles having cross-sections which are bounded by a circle of constant diameter, wherein the bristles of the tuft comprise at least two groups, the bristles of one group being arranged to have a different mechanical behavior in flexure from that of the bristles of another group so that these groups give a brush tuft which is open to the air and spread out with relatively large spaces between adjacent bristles, to promote good capillary action for varnishes whose viscosity may vary over a wide range.

2. Brush according to claim 1, wherein the bristles of said one group are made of a different material from the bristles of said another group, these different materials having different elasticity coefficients leading to the different mechanical behavior of the groups of bristles, the elasticity coefficient of the material of the bristles of said one group varying by from 10% to 200% with respect to the elasticity coefficient of the material of the bristles of the another group.

3. Brush according to claim 1, wherein the bristles of said one group have a cross-sectional shape different from that of the bristles of the another group, these shape differences leading to differences in flexural resistance.

4. Brush according to claim 1, wherein the one group of bristles constitutes of 5 to 95% of the total number of bristles in the brush, and the remaining bristles constitute the complement, namely 95 to 5% of the total number of bristles.

5. Brush according to claim 1, wherein the one group of bristles is made of a material selected from the group consisting of a polyamide, a polyether-block-amide and a polyester elastomer.

6. Brush according to claim 1, wherein the another group of bristles is made of a material selected from the group consisting of nylon 11, polyamide, polyethylene, polytetrafluorethylene, polyvinylidene fluoride, polyacetate, and polyethylene terephthalate.

7. Brush according to claim 1, wherein the housing of the rod has a flared shape, a large base of which is located at the end of the rod.

8. Brush according to claim 7, wherein the flared shape is axisymmetrically frustoconical.

9. Brush according to claim 7, wherein the flared shape is selected from the group consisting of a truncated pyramid, funnel, and cylindrical shape with a shoulder defining a region of larger diameter than a bottom region of the housing where the fixing of the tuft takes place.

10. Brush according to claim 1, wherein a cross-section of a shape of the end of the rod is selected from the group consisting of round, square, rectangular, triangular, oval and cruciform.

11. Brush according to claim 1, wherein the folded part of the bristles is fixed by a staple forcibly pushed into the housing in the rod.

12. Brush according to claim 1, wherein the bristles of the brush project beyond the end of the rod by a length ranging between 12 and 30 mm.

13. Brush according to claim 3, wherein the bristles have a cross-section bounded by a circle of constant diameter in the range of $^{3}/_{100}$ and $^{18}/_{100}$ mm.

14. Brush according to claims 3 and 13, wherein a shape of the cross-section of a bristle of the one group is selected from the group consisting of solid circular, hollow circular, horseshoe-shaped, V-shaped, flat, cruciform and one equipped with a capillary grove.

15. Brush according to claims 5 or 6, wherein additives modifying at least one of the surface finish and surface tension are incorporated into the material of the bristles.

16. Brush according to claim 1, wherein the bristles have a diameter ranging between $^{11}/_{100}$ and $^{40}/_{100}$ of a millimeter.

17. Brush for the application of nail varnishes of varying viscosities, comprising:

a bristle tuft which is fixed at an end of a rod by engagement of the bristle tuft in a housing opening formed at the end of the rod, the bristles having a cross-section bounded by a circle of constant diameter, wherein said housing opening has a funnel shape with a large conical portion continuous with a relatively smaller cylindrical portion axisymmetrical therewith, the large portion being located at the end of the rod, this shape making the tuft open to the air and spread out with relatively large spaces between adjacent bristles, to promote good capillary action for the varnishes.

18. Brush according to claim 17, wherein the shape and material of the bristles are identical.

19. Brush according to claim 17, wherein at least some of the bristles are made of natural material, selected from the group consisting of natural silks.

20. Brush according to claim 17, wherein at least some of the bristles are made from a synthetic material selected from the group consisting of polyamides, polyesters, polyether-block-amides, polyethylenes, polytetrafluoroethylenes, polyvinylidene fluorides, polyacetals and polyethylene-terephthalates.

21. Brush according to claim 20, wherein the bristles are unfolded.

22. Brush according to claim 17, wherein the bristles belong to at least two groups which differ in at least one of shape and material.

23. Brush according to claim 17, wherein the bristles are folded and the folded part is fixed by a staple forcibly pushed into the housing of the rod.

24. Brush according to claim 17, wherein the bristles of the brush project beyond the end of the rod by a length ranging between 12 and 30 mm.

25. Brush according to claim 17, wherein the diameter of the circle is between 3/100 mm and 18/100 mm.

26. Brush according to claim 22, wherein the shape of the cross-section of the bristles of one group is selected from the group consisting of solid circular, hollow circular, horse-shoe-shaped, V-shaped, flat, cruciform, and one equipped with capillary groves.

27. Brush according to claim 22, wherein additives modifying surface finish and surface tension are incorporated into the material of the bristles.

28. Brush according to claim 17, wherein the bristles have a diameter of from 11 hundredths to 40 hundredths of a millimeter.

29. Brush according to claim 17, wherein the bristles are hollow.

30. A method for the application of nail varnish, whose viscosity lies within the 200 to 2,000 cP range, comprising the steps of:

(a) providing a brush comprising bristles forming a tuft obtained from a bundle of bristles which are substantially parallel and folded in two approximately halfway along their length, the folded part being fixed in a housing opening at an end of a rod, the bristles having cross-sections which are bounded by a circle of constant diameter, the bristles of the tuft comprise at least two groups, the bristles of one group being arranged to have a different mechanical behavior in flexure from that of the bristles of another group so that these groups give a brush tuft that is open to the air and spread out with relatively large spaces between adjacent bristles, to promote good capillary action for the varnish; and (b) applying the vanish to a surface using the bristles.

* * * * *